US009217625B2

(12) United States Patent
DeJong

(10) Patent No.: US 9,217,625 B2
(45) Date of Patent: Dec. 22, 2015

(54) SHOTSHELL TYPE AMMUNITION USABLE IN MAGAZINE-FED FIREARMS, AND METHODS OF MANUFACTURING SUCH SHOTSHELL TYPE AMMUNITION

(71) Applicant: Intrepid Tactical Solutions, LLC, Salt Lake City, UT (US)

(72) Inventor: William E. DeJong, Hayden, ID (US)

(73) Assignee: Intrepid Tactical Solutions, Inc., Salt Lake City, UT (US)

( * ) Notice: Subject to any disclaimer, the term of this patent is extended or adjusted under 35 U.S.C. 154(b) by 0 days.

(21) Appl. No.: 13/675,895

(22) Filed: Nov. 13, 2012

(65) Prior Publication Data

US 2014/0130696 A1 May 15, 2014

(51) Int. Cl.

| | |
|---|---|
| ***F42B 7/04*** | (2006.01) |
| ***F42B 7/06*** | (2006.01) |
| ***F42B 7/10*** | (2006.01) |
| ***F42B 7/08*** | (2006.01) |
| ***F42B 33/00*** | (2006.01) |
| ***F42B 5/03*** | (2006.01) |
| ***F42B 12/64*** | (2006.01) |
| ***F42B 14/06*** | (2006.01) |
| *F42B 5/30* | (2006.01) |

(52) U.S. Cl.

CPC ... *F42B 7/04* (2013.01); *F42B 5/03* (2013.01); *F42B 7/06* (2013.01); *F42B 7/08* (2013.01); *F42B 7/10* (2013.01); *F42B 12/64* (2013.01); *F42B 14/065* (2013.01); *F42B 33/00* (2013.01); *F42B 5/30* (2013.01)

(58) Field of Classification Search

CPC ..... F42B 7/00; F42B 7/02; F42B 7/04; F42B 7/06; F42B 7/08; F42B 7/10; F42B 5/30; F42B 33/001; F42B 33/00

USPC ..... 102/438, 439, 448–463

See application file for complete search history.

(56) References Cited

U.S. PATENT DOCUMENTS

| | | | |
|---|---|---|---|
| 338,192 | A | 3/1886 | Rubin |
| 1,557,695 | A | 10/1925 | Roy |

(Continued)

FOREIGN PATENT DOCUMENTS

| | | | |
|---|---|---|---|
| WO | 8301300 | A1 | 4/1983 |
| WO | 9940387 | A1 | 8/1999 |

OTHER PUBLICATIONS

Saiga-12, Wikipedia: the Free Encyclopedia, last modified Jun. 2, 2013, <http://en.wikipedia.org/wiki/Saiga_12>.

(Continued)

*Primary Examiner* — James S Bergin

(74) *Attorney, Agent, or Firm* — TraskBritt, P.C.

(57) ABSTRACT

Shotshell type ammunition includes a hull, a wad member disposed within the hull, and at least one projectile disposed within at least partially the hull. The hull has a rimless proximal end that includes a primer for firing the ammunition. The hull also has a seat surface for seating the hull against a complementary seat surface in a firing chamber of a firearm. The seat surface is located a distance from an outer end surface of the hull at the rimless proximal end. The hull further includes an outer side surface extending from the rimless proximal end of the hull to the seat surface of the hull. Methods of fabricating such ammunition include forming such a hull, and providing a wad member and one or more projectiles at least partially within the hull.

9 Claims, 6 Drawing Sheets

(56) References Cited

U.S. PATENT DOCUMENTS

| | | | | | |
|---|---|---|---|---|---|
| 1,557,696 | A | | 10/1925 | Roy | |
| 1,738,439 | A | * | 12/1929 | Leve | F41A 9/65 42/18 |
| 2,765,558 | A | * | 10/1956 | Roper | F41A 17/38 42/18 |
| 2,766,692 | A | | 10/1956 | Mynes | |
| 2,840,944 | A | | 7/1958 | Thompson | |
| 2,869,270 | A | | 1/1959 | Simmons | |
| 3,179,051 | A | | 4/1965 | Morse | |
| 3,283,720 | A | | 11/1966 | Foote et al. | |
| 3,527,137 | A | | 9/1970 | Scanlon | |
| 3,598,057 | A | | 8/1971 | Potter | |
| 3,602,086 | A | | 8/1971 | Billingslea et al. | |
| 3,609,904 | A | | 10/1971 | Scanlon | |
| 3,670,651 | A | * | 6/1972 | Mertens | 102/452 |
| 3,728,966 | A | | 4/1973 | Woodring | |
| 4,085,677 | A | | 4/1978 | Marcinkiewicz | |
| 4,194,657 | A | | 3/1980 | Thor | |
| 4,290,365 | A | | 9/1981 | Dreyer | |
| 4,479,438 | A | | 10/1984 | Bilsbury | |
| 4,553,480 | A | | 11/1985 | McLellan | |
| 4,614,051 | A | | 9/1986 | Thacker | |
| 4,686,905 | A | | 8/1987 | Szabo | |
| 4,742,774 | A | | 5/1988 | Flatau | |
| 4,805,333 | A | * | 2/1989 | Doria | F41A 9/65 42/50 |
| 4,864,758 | A | * | 9/1989 | Crossman | F41A 9/23 42/18 |
| 5,221,809 | A | | 6/1993 | Cuadros | |
| 5,408,931 | A | | 4/1995 | Tallman | |
| 5,644,100 | A | | 7/1997 | Puckett et al. | |
| 5,708,231 | A | * | 1/1998 | Koon | 102/439 |
| 5,829,180 | A | | 11/1998 | Leiter | |
| 6,324,984 | B1 | | 12/2001 | Dindl | |
| 6,367,388 | B1 | | 4/2002 | Billings | |
| 7,228,801 | B2 | | 6/2007 | Dunnam et al. | |
| 7,357,082 | B1 | | 4/2008 | Racho | |
| 7,380,363 | B1 | | 6/2008 | Kirschner | |
| 7,610,857 | B1 | | 11/2009 | Dunnam et al. | |
| 7,926,424 | B1 | | 4/2011 | Quintana et al. | |
| 7,941,957 | B2 | | 5/2011 | Carr et al. | |
| 8,001,903 | B1 | | 8/2011 | Quintana et al. | |
| 8,122,633 | B2 | | 2/2012 | Kerbrat et al. | |
| 8,161,886 | B2 | | 4/2012 | Meyer | |
| 8,281,699 | B2 | | 10/2012 | Jebsen et al. | |
| 8,281,720 | B2 | * | 10/2012 | Dindl et al. | 102/438 |
| 8,448,364 | B2 | * | 5/2013 | Davidson | F41A 9/69 42/50 |
| 8,572,878 | B2 | | 11/2013 | Gentilini et al. | |
| 8,985,004 | B2 | * | 3/2015 | DeJong | F42B 7/04 102/439 |
| 9,109,850 | B2 | * | 8/2015 | DeJong | F41A 21/12 1/1 |
| 2003/0167958 | A1 | | 9/2003 | Johansson | |
| 2004/0244629 | A1 | | 12/2004 | Jopson | |
| 2005/0183616 | A1 | | 8/2005 | Eberhart | |
| 2005/0211125 | A1 | | 9/2005 | Amick | |
| 2006/0236888 | A1 | | 10/2006 | Brunn | |
| 2007/0214992 | A1 | | 9/2007 | Dittrich | |
| 2007/0272112 | A1 | | 11/2007 | Nielson et al. | |
| 2007/0272113 | A1 | | 11/2007 | Meyer et al. | |
| 2008/0163533 | A1 | | 7/2008 | Racho | |
| 2010/0037794 | A1 | | 2/2010 | Authement, Sr. | |
| 2010/0064566 | A1 | | 3/2010 | Kerbrat et al. | |
| 2010/0282110 | A1 | | 11/2010 | Sexton | |
| 2011/0041680 | A1 | | 2/2011 | Smirnov | |
| 2011/0168009 | A1 | | 7/2011 | Robb et al. | |
| 2012/0167755 | A1 | | 7/2012 | Rosol et al. | |
| 2012/0304518 | A1 | | 12/2012 | Kerbrat et al. | |
| 2013/0014664 | A1 | * | 1/2013 | Padgett | 102/439 |
| 2013/0047831 | A1 | | 2/2013 | DeJong | |
| 2013/0047880 | A1 | | 2/2013 | O'Dwyer | |
| 2013/0291419 | A1 | | 11/2013 | Heath | |
| 2014/0130696 | A1 | | 5/2014 | DeJong | |
| 2014/0130697 | A1 | | 5/2014 | DeJong | |
| 2014/0283673 | A1 | * | 9/2014 | DeJong | 89/14.05 |

OTHER PUBLICATIONS

MKA 1919: Wikipedia: the Free Encyclopedia, last modified Jun. 4, 2013, <http://en.wikipedia.org/wiki/Akdal_MKA_1919>.

Snake/Rat Shot; Wikipedia: the Free Encyclopedia, last modified Jun. 4, 2013, <http://en.wikipedia.org/wiki/Rat_shot>.

Campbell, R.K., Handgun Shot Loads Work for Pests Bu Not Defense, no date; <http://www.gunweek.com/2005/feature1001.html>.

Pest Control/Specialty, CCI The Leader in Rimfire Ammunition, no date, <http://www.cci-ammunition.com/products/pestcontrol_specialty.aspx>.

International Search Report and Written Opinion for PCT application No. PCT/US2013/069865, mailed Mar. 18, 2014.

Supplementary European Search Report for European Application No. 12838751.1, mailed Feb. 18, 2015, 4 pages.

* cited by examiner

SHOTSHELL TYPE AMMUNITION USABLE IN MAGAZINE-FED FIREARMS, AND METHODS OF MANUFACTURING SUCH SHOTSHELL TYPE AMMUNITION

CROSS-REFERENCE TO RELATED APPLICATION

The subject matter of this application is related to the subject matter of U.S. patent application Ser. No. 13/592,798, filed Aug. 23, 2012, in the name of DeJong, which is incorporated herein in its entirety by this reference.

TECHNICAL FIELD

The present disclosure relates to shotshell type ammunition for shotgun type firearms, to shotgun type firearms configured for firing shotshell type ammunition, and to methods of manufacturing such shotshell type ammunition.

BACKGROUND

Conventional shotshell ammunition for firing from a shotgun has a hull that includes a metal cup-shaped structure defining a closed firing end of the ammunition, and a cylindrical portion that extends from the metal cup-shaped structure. A primer is provided at the firing end of the ammunition in an aperture extending through the cup-shaped structure. Gun powder is disposed within the hull within the metal cup-shaped structure and adjacent the primer. One or more projectiles are disposed within a sabot, and the sabot is disposed within the hull adjacent the gun powder such that the gun powder is disposed in a space between the metal cup-shaped structure of the hull and the sabot with the projectile(s) therein. As used herein, the term "sabot" means a structure in which a projectile is carried through a barrel of a firearm and which separates from the projectile upon exiting the barrel of the firearm. The projectile may include a plurality of generally spherical rounded pellets, which are often referred to as the "shot" of the ammunition. The cylindrical portion of the hull is typically formed of plastic, and an end of the plastic cylindrical portion of the hull opposite the metal cup-shaped structure is mechanically deformed (by rolling, folding, etc.) and crimped to close the end of the ammunition (opposite the firing end of the ammunition) from which the sabot (and the one or more projectiles carried therein) exits the hull upon firing of the ammunition.

In conventional shotshell ammunition, the cylindrical portion of the hull has a maximum outer diameter that is smaller than a maximum outer diameter of the metal cup-shaped structure defining the closed firing end of the ammunition. Thus, the cup-shaped structure includes or defines a rim that projects outwardly in the radial direction beyond the outer surface of the cylindrical portion of the hull, and, in some previously known ammunition, a portion of the metal-cup-shaped structure having a reduced outer diameter. Conventional shotguns include a seat surface that is configured to abut against the metal rim at the firing end of the ammunition so as to prevent longitudinal forward movement of the hull within the shotgun when the shotshell type ammunition is loaded into and fired from the shotgun.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes shotshell type ammunition. The shotshell type ammunition includes a hull, a wad member disposed within the hull, and at least one projectile disposed at least partially within the hull. The hull has a rimless proximal end that includes a primer for firing the ammunition, an opposing distal end from which the at least one projectile may be ejected out from the hull upon firing the ammunition, a proximal end surface at the rimless proximal end, and a seat surface for seating the hull against a complementary seat surface in a firing chamber of a firearm. The seat surface is located a distance from the outer proximal end surface of the hull, and an outer side surface of the hull extends from the rimless proximal end of the hull to the seat surface of the hull. At least a portion of the wad member is disposed longitudinally between the seat surface of the hull and the outer proximal end surface of the hull.

In additional embodiments, the present disclosure includes a shotshell type ammunition having a hull, a wad member disposed within the hull, and at least one projectile disposed at least partially within the hull. The hull has a rimless proximal end that includes a primer for firing the ammunition, an opposing distal end from which the at least one projectile may be ejected out from the hull upon firing the ammunition, a proximal end surface at the rimless proximal end, and a seat surface for seating the hull against a complementary seat surface in a firing chamber of a firearm. The seat surface is located at least about 0.635 centimeters (about ¼ of an inch) from the outer proximal end surface of the hull. An outer side surface of the hull extends from the rimless proximal end of the hull to the seat surface of the hull. The wad member and at least a portion of the at least one projectile are disposed longitudinally between the seat surface of the hull and the outer proximal end surface of the hull.

In yet further embodiments, the present disclosure includes a method of manufacturing a shotshell type ammunition. A hull is provided that has a rimless proximal end, an opposing distal end from which a projectile may be ejected out from the hull upon firing the ammunition, a seat surface for seating the hull against a complementary seat surface in a firing chamber of a firearm, the seat surface located a distance from an outer proximal end surface of the hull at the rimless proximal end, and an outer side surface extending from the rimless proximal end of the hull to the seat surface of the hull. A primer is provided at the rimless proximal end of the hull for firing the ammunition, and gun powder is provided within the hull. A wad member is provided within the hull at a location at which at least a portion of the wad member is disposed longitudinally between the seat surface of the hull and the outer proximal end surface of the hull. At least one projectile is provided within the hull.

DETAILED DESCRIPTION

The illustrations presented herein are not meant to be actual views of any particular ammunition round, firearm, or component thereof, but are merely idealized representations that are used to describe embodiments of the disclosure.

As used herein, the term "proximal," when used in relation to an ammunition or a component of an ammunition, means proximate or nearer to a firing pin of a firearm when the ammunition is loaded within a firearm. As used herein, the term "distal," when used in relation to an ammunition or a component of an ammunition, means remote or farther from a firing pin of a firearm when the ammunition is loaded within a firearm.

Figure 1:
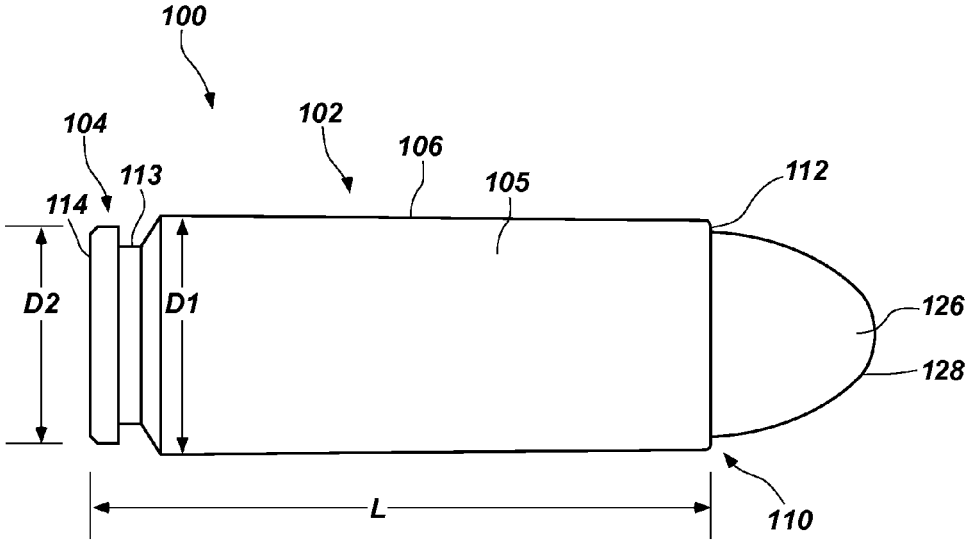
FIG. 1 is a longitudinal side view of an embodiment of shotshell type ammunition of the present disclosure.
Figure 2:
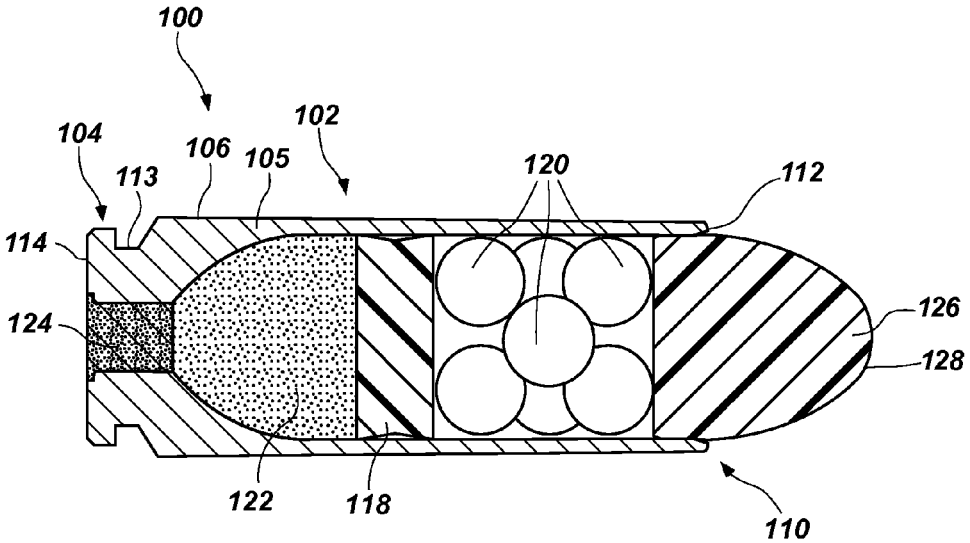
FIG. 2 is a longitudinal cross-sectional side view of the shotshell type ammunition of FIG. 1.
Figure 3:
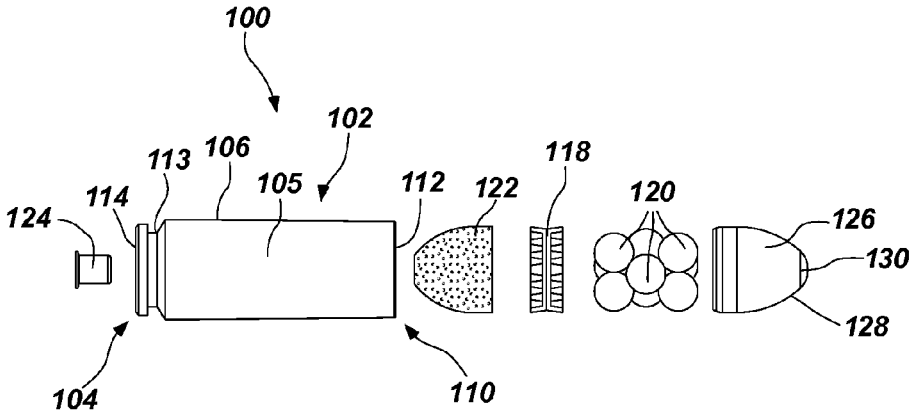
FIG. 3 is an exploded longitudinal cross-sectional side view of the shotshell type ammunition of FIG. 1.

FIGS. 1 through 3 illustrate an embodiment of a shotshell type ammunition 100 of the present disclosure. The shotshell type ammunition 100 includes a hull 102, gun powder 122 (FIG. 2) disposed within the hull 102, a wad member 118 (FIG. 2) disposed within the hull 102, and at least one projectile 120 (FIG. 2) disposed at least partially within the hull 102 on a side of the wad member 118 opposite the gun powder 122. The shotshell type ammunition 100 may also include a nose member 126 on a side of the at least one projectile 120 opposite the wad member 118, such that the at least one projectile 120 is disposed between the wad member 118 and the nose member 126.

The hull 102 has a rimless proximal end 104, an opposing distal end 110, and a seat surface 112 for seating the hull 102 against a complementary seat surface in a firing chamber of a firearm. The seat surface 112 may be located a distance from an outer proximal end surface 114 of the hull 102 at the rimless proximal end 104. The hull 102 may include a cylindrical portion 105 having an outer side surface 106, which may extend from the rimless proximal end 104 of the hull 102 to the seat surface 112 of the hull 102. The outer side surface 106, the outer proximal end surface 114, and the seat surface 112 may define what is referred to in the art as the "head space" of the shotshell type ammunition 100. The seat surface 112 may be sized and configured to abut against a complementary seat surface in a firing chamber of a firearm, as described in further detail herein below, and may be used for ensuring precise and accurate positioning of the shotshell type ammunition 100 within the firing chamber of a firearm when the ammunition 100 is loaded into and fired within the firing chamber.

The hull 102 may comprise, for example, a metal (e.g., brass, etc.) or a polymer. As non-limiting examples, such a polymer material may comprise a polycarbonate material, a nylon material, or another type of thermoplastic polymer material. Further, the polymer material may include a discontinuous filler material, such as glass particles (e.g., fibers). In some embodiments, a portion of the hull 102 may comprise a metal, and another portion of the hull 102 may comprise a polymer, such as a plastic. For example, the rimless proximal end 104 of the hull 102 may comprise a metal, and at least a portion of the cylindrical portion 105 of the hull 102 between the seat surface 112 and the distal end 110 may comprise a polymer, such as a plastic material.

The shotshell type ammunition 100 may include a groove 113 extending into the hull 102 on a lateral side of the hull 102 proximate the rimless proximal end 104 of the hull 102. The groove 113 may be located and configured for use by a mechanism of a firearm to eject the shotshell type ammunition 100 out from the firearm after firing the shotshell type ammunition 100.

As shown in FIG. 2, the rimless proximal end 104 of the hull 102 may include a primer 124 for firing the ammunition 100. When struck by a firing pin of a shotgun type firearm, the primer 124 may ignite the gunpowder 122 within the hull 102. The expanding gases generated by ignition of the gunpowder 122 forces the wad member 118 and the at least one projectile 120 out from the distal end 110 of the hull 102. The wad member 118 may comprise, for example, a plastic or other polymeric material that will provide a gas seal behind the wad member 118 to prevent the expanding gases generated by the combusting gun powder from blowing past the projectile(s) 120 within the bore of the barrel of the firearm, and increasing the efficiency with which the energy is transferred to the projectile(s) 120.

The at least one projectile 120 disposed at least partially within the hull 102 may be any of a number of different types of projectiles. Further, the at least one projectile 120 may comprise one projectile, or more than one projectile. Thus, as a non-limiting example, the at least one projectile 120 may comprise a plurality of rounded pellets, which are often referred to in the art as "shot." In other embodiments, however, at least one projectile 120 may comprise a metal slug, for example. In yet further embodiments, the at least one projectile 120 may comprise a non-lethal or less-lethal projectile, such as one or more rubber masses, a bean bag, etc. In yet further embodiments, the at least one projectile 120 may include an electronic device that is operational after it has been fired from a firearm, such as an electronic audio transmitter device configured to detect audible sound in the vicinity of the device and to wirelessly transmit electronic signals carrying the detected audible sounds to a remote receiver.

As shown in FIG. 2, at least a portion of the wad member 118 may be disposed longitudinally between the seat surface 112 of the hull 102 and the outer proximal end surface 114 of the hull 102. In some embodiments, the wad member 118 and at least a portion of the at least one projectile 120 may be disposed longitudinally between the seat surface 112 of the hull 102 and the outer proximal end surface 114 of the hull 102.

The seat surface 112 may be located a distance L from the outer proximal end surface 114 of the hull 102. In some embodiments, the distance L may be at least about 0.318 centimeters (about ⅛ of an inch), at least about 0.635 centimeters (about ¼ of an inch), at least about 1.270 centimeters (about ½ of an inch), or even at least about 2.540 centimeters (about 1 inch).

The outer side surface 106 of the hull 102 defines a maximum diameter of the shotshell type ammunition 100. Thus, the proximal end 104 of the hull 102 is referred to herein as a "rimless" proximal end 104 because the proximal end 104 does not project laterally outward from the hull 102 radially beyond the outer side surface 106. In other words, the diameter of the hull 102 at the proximal end 104 is equal to or less than the diameter of the outer side surface 106 of the hull 102, which extends to the seat surface 112 and may have a length as previously described. Stated another way, the outer side surface 106 may have a first diameter $D_1$, and the outer proximal end surface 114 of the hull 102 at the rimless proximal end 104 may have a second diameter $D_2$ at least substantially equal to or smaller than the first diameter $D_1$.

In contrast, previously known standard shotshell type ammunition has a rimmed proximal end, wherein the proximal end of the hull projects laterally outward radially beyond the cylindrical portion of the hull, so as to define a rim at the proximal end of the ammunition which is used to seat the ammunition within the firearm (the function performed by the seat surface 112 in embodiments of the present disclosure). In other words, the diameter $D_2$ is greater than the diameter $D_1$ in previously known standard shotshell type ammunition.

The hull 102 includes a cylindrical portion 105 that extends from the rimless proximal end 104 of the hull 102 to the open distal end 110 of the hull 102. A longitudinal end surface of the cylindrical portion 105 defines the seat surface 112 of the hull 102. An outer side surface 106 of the cylindrical portion 105 of the hull 102 may extend from at least proximate the rimless proximal end 104 of the hull 102 to the seat surface 112 of the hull 102. The diameter of the outer side surface 106 of the cylindrical portion 105 defines a maximum diameter of the hull 102.

As previously mentioned, the ammunition 100 may include a nose member 126 disposed at least partially within the hull 102 at the distal end 110 of the hull 102. The nose member 126 may project longitudinally beyond the seat surface 112 prior to firing of the shotshell type ammunition 100. As shown in FIG. 2, a portion of the nose member 126 may be contained within the hull 102.

The nose member 126 may have a distal rounded end surface 128 that projects longitudinally beyond the seat surface 112. The rounded end surface 128 may project beyond the seat surface 112 at the open end 110 of the cylindrical portion 105 of the hull 102 prior to firing of the shotshell type ammunition 100. The rounded end surface 128 may have, for example, a cone shape or a dome shape. In other embodiments, the nose member 126 may not have a rounded end surface 128, but may instead may have a polygonal end surface, or may be flat, for example.

In some embodiments, the nose member 126 may be configured to break apart into two or more portions as the upon firing the shotshell type ammunition 100 such that, after the nose member 126 leaves the barrel of the firearm, the portions will at least partially separate from one another so as to allow the one or more projectiles 120 to pass by the nose member 126 and continue their trajectory from the barrel, as described below with reference to FIG. 13. The nose member 126 may include at least one feature, such as a recess or aperture 130, at the forward rounded end surface 128 of the nose member 126, which may be configured to assist in fracturing of the nose member 126 as the nose member 126 exits the barrel of a firearm upon firing the ammunition 100. Further, the nose member 126 may comprise a plastic or other polymer material that is brittle and less pliable relative to the wad member 118 so as to facilitate fracture of the nose member 126 after exiting the barrel.

In other embodiments, the nose member 126 may include two, three, or more separable portions that, when assembled together, form the nose member 126. In some embodiments, the two, three, or more separable portions may be lightly bonded to one another to facilitate assembly and insertion of the nose member 126 into the hull 102, while allowing the separable portions to separate from one another upon exiting the barrel of a firearm after firing the ammunition 100, as described below with reference to FIG. 13. In other words, as the nose member 126 exits the barrel of a firearm upon firing the ammunition 100, the two, three, or more portions of the nose member 126 may at least partially separate from one another so as to allow the one or more projectiles 120 to pass by the nose member 126 and continue their trajectory from the barrel. The nose member 126 may include at least one feature, such as a recess or aperture 130, at the forward rounded end surface 128 of the nose member 126, which may be configured to urge the at least partial separation of different regions of the nose member 126 and allow the one or more projectiles 120 to pass the nose member 126 as the nose member 126 exits the barrel of a firearm upon firing the ammunition 100.

The nose member 126 may be retained within the hull 102 using, for example, an interference fit between the nose member 126 and the hull 102. For example, the nose member 126 may have a cylindrical outer side surface having a maximum diameter, and the hull 102 may have a cylindrical inner surface having a minimum diameter equal to or smaller than the maximum diameter of the cylindrical outer side surface of the nose member 126. In such a configuration, the nose member 126 may be inserted into the hull 102 using a press-fitting process and/or a shrink-fitting process, for example. The mechanical interference between the cylindrical outer side surface of the nose member 126 and the cylindrical inner surface of the hull 102 may retain the nose member 126 within the hull 102 until the ammunition 100 is fired from a firearm. In other embodiments, an adhesive may be used to bond the nose member 126 within the hull 102 instead of, or in addition to, using a press-fitting process and/or a shrink-fitting process.

The distal end of the shotshell type ammunition 100 is not crimped, as is conventional shotshell type ammunition. As a result, the interior surface of the barrel of a firearm used to fire the shotshell type ammunition 100 does not need to include a forcing cone (a frustoconical-shaped portion of the interior surface), as do the barrels of conventional shotgun type firearms used to fire conventional shotshell type ammunition. Thus, the interior surface of the barrel of a shotgun type firearm configured to fire the shotshell type ammunition 100 may have an at least substantially uniform diameter extending from a location of the seat surface 112 when the ammunition 100 is fully seated within the barrel to a location proximate the distal end of the barrel (but for any variation provided by a so-called "choke tube," which is commonly employed at the distal end of the barrel of shotgun type firearms). The lack of such a forcing cone in embodiments of firearms of the present disclosure may reduce recoil felt by users of such firearms.

With continued reference to FIGS. 1 through 3, the diameter $D_1$ of the outer side surface 106 of the hull 102 may vary depending on the size of the shotgun type firearm from which the ammunition is to be fired. As known in the art, shotgun type firearms commonly have one of a 10 gauge bore size, a 12 gauge bore size, a 16 gauge bore size, a 20 gauge bore size, a 28 gauge bore size, and a 68 gauge bore size. As non-limiting examples, Table 1 below provides ranges for the maximum diameter $D_1$ of the outer side surface 106 of the hull 102 for different firearm bore sizes.

TABLE 1

| Bore Size | Maximum Diameter $D_1$ |
|---|---|
| 10 Gauge | 2.134 centimeters (about 0.840 inches) to 2.370 centimeters (about 0.933 inches) |
| 12 Gauge | 2.024 centimeters (about 0.797 inches) to 2.250 centimeters (about 0.886 inches) |
| 16 Gauge | 1.857 centimeters (about 0.731 inches) to 2.080 centimeters (about 0.819 inches) |
| 20 Gauge | 1.737 centimeters (about 0.684 inches) to 1.948 centimeters (about 0.767 inches) |
| 28 Gauge | 1.560 centimeters (about 0.614 inches) to 1.748 centimeters (about 0.688 inches) |
| 68 Gauge | 1.173 centimeters (about 0.462 inches) to 1.361 centimeters (about 0.536 inches) |

The ranges provided in Table 1 are provided as examples only, and the maximum diameter $D_1$ of the outer side surface 106 of the hull 102 may be outside the ranges set forth in Table 1 for the corresponding firearm bore size in additional embodiments of the disclosure.

Figure 4:
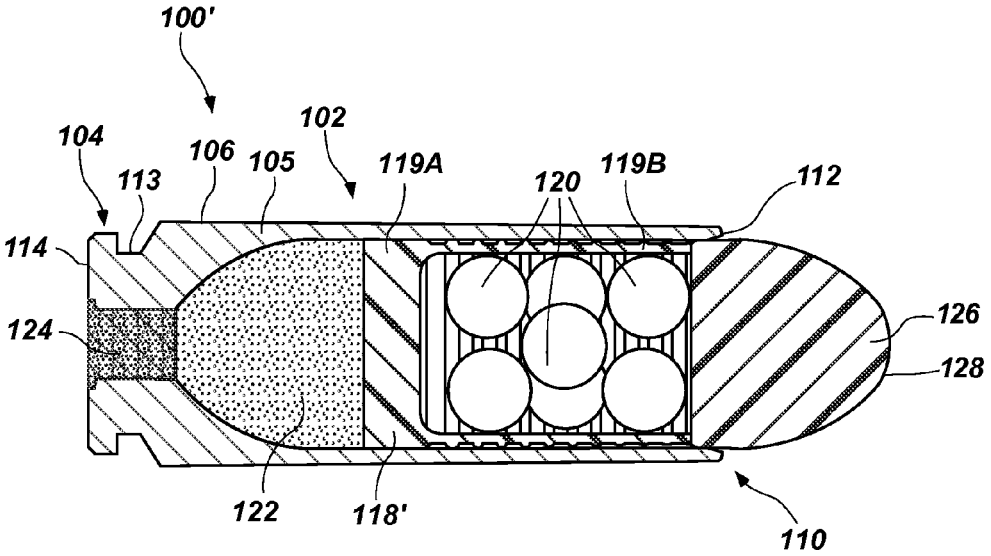
FIG. 4 is a longitudinal cross-sectional side view of another embodiment of shotshell type ammunition of the present disclosure.
Figure 5:
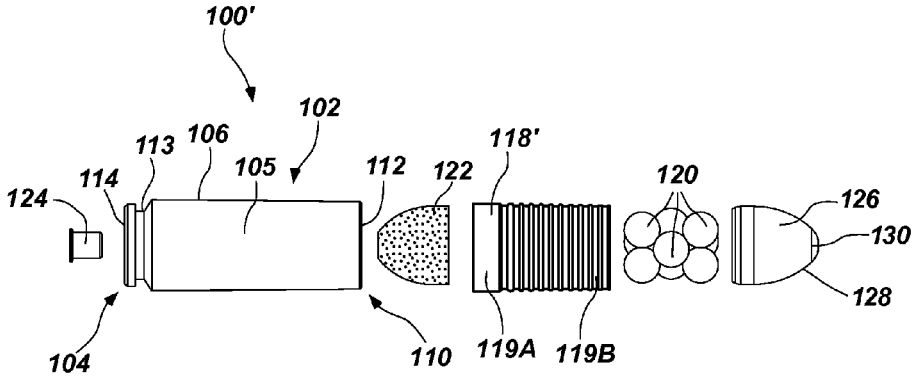
FIG. 5 is an exploded longitudinal cross-sectional side view of the shotshell type ammunition of FIG. 4.

FIGS. 4 and 5 illustrate an additional embodiment of a shotshell type ammunition 100' of the present disclosure. The shotshell type ammunition 100' is substantially similar to the shotshell type ammunition 100 of FIGS. 1 through 3, but includes a wad member 118' having a base portion 119A and a cup-shaped portion 119B in which the one or more projectiles 120 may be disposed. In some embodiments, the base portion 119A and the cup-shaped portion 119B may be different regions of an integral body. In other embodiments, they may be separate members that are assembled together within the shotshell ammunition 100'. Upon firing the shotshell type ammunition 100', the wad member 118' is propelled through the barrel of the firearm while the one or more projectiles 120 are carried within the cup-shaped portion 119B of the wad member 118'. Thus, the cup-shaped portion 119B of the wad member 118' may protect surfaces of the barrel within the bore from the projectile or projectiles 120. In some embodiments, the cup-shaped portion 119B of the wad member 118' may be configured to at least partially separate into two or more portions to facilitate separation of the wad member 118' from the projectile(s) 120 as the projectile(s) continue on the intended trajectory.

Figure 6:
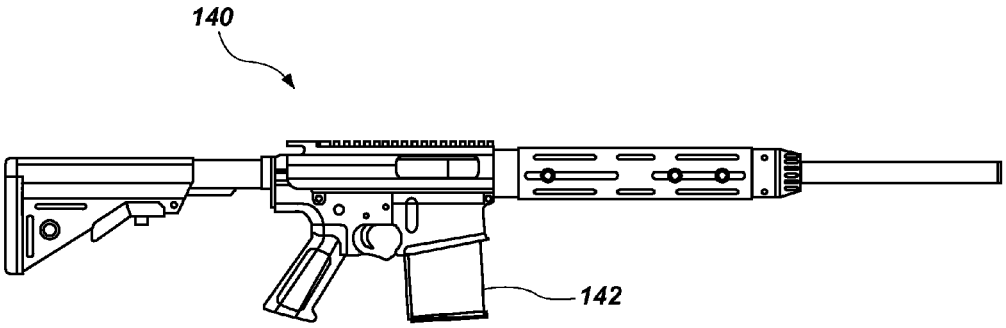
FIG. 6 is a side view of an embodiment of a shotgun type firearm of the present disclosure configured to fire shotshell type ammunition, such as that shown in FIGS. 1 through 3.

Additional embodiments of the present disclosure include shotgun type firearms that are configured for firing shotshell type ammunition as described herein. FIG. 6 illustrates a non-limiting example embodiment of a shotgun type firearm 140 of the present disclosure. The shotgun type firearm 140 may comprise a magazine 142 configured to hold two or more rounds of shotshell type ammunition in a vertical stack therein. The magazine 142 may be configured to be attached and detached from the firearm 140 in a repeatable manner. The shotgun type firearm 140 may comprise a semi-automatic or automatic repeating firearm, and ammunition may be sequentially fed from the magazine 142 into the firing chamber of the firearm 140 in an at least substantially automatic manner upon firing the firearm 140. The magazine 142 may be removed from the firearm to reload the magazine 142 with ammunition, after which the magazine 142 may again be coupled with the firearm 140.

Figure 7:
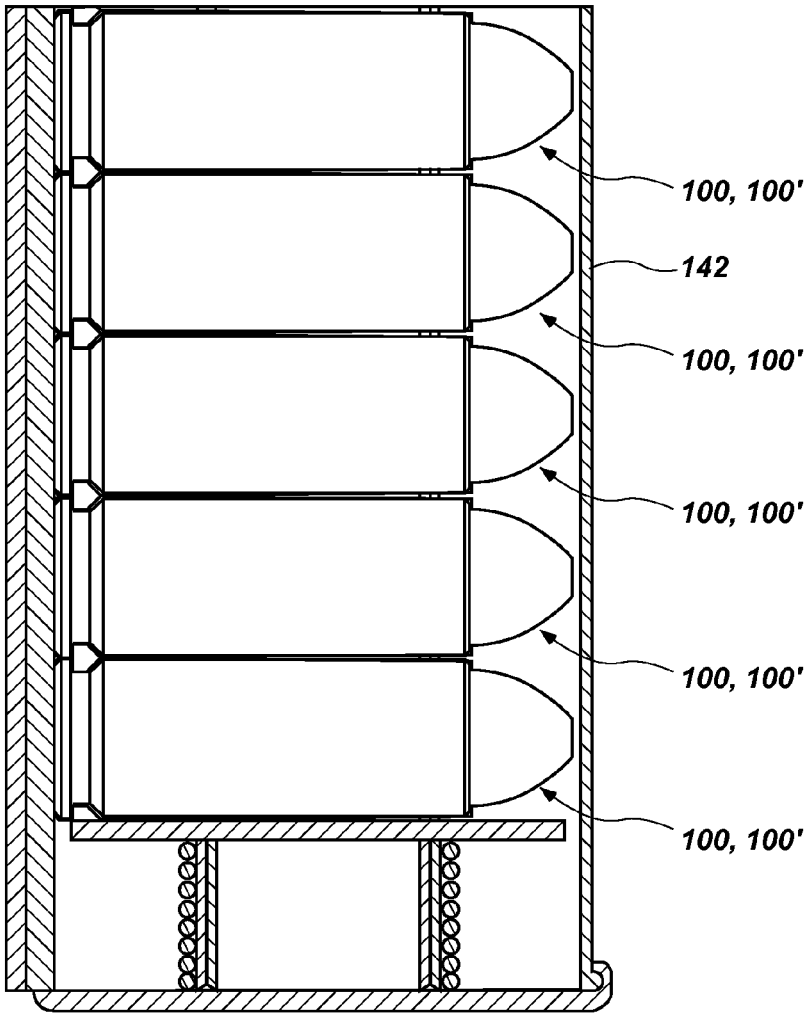
FIG. 7 is a cross-sectional view of a magazine of the firearm of FIG. 6 loaded with shotshell type ammunition as described herein.
Figure 8:
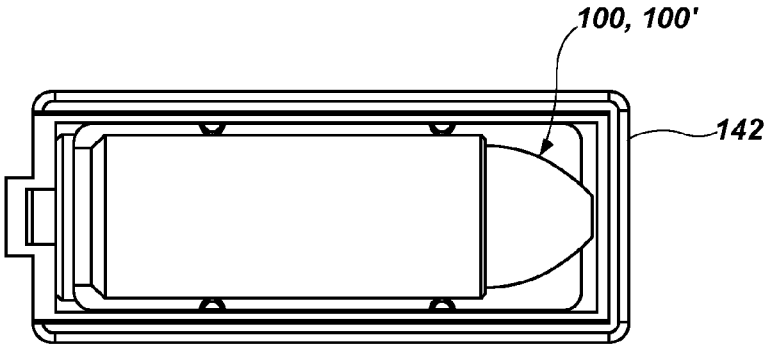
FIG. 8 is a top view of the loaded magazine of FIG. 7.

FIG. 7 illustrates a cross-sectional side view of the magazine 142 of FIG. 6, separate from the shotgun type firearm 140, and loaded with five rounds of shotshell type ammunition 100 as previously described with reference to FIGS. 1 through 3. As shown in FIG. 7, the shotshell type ammunition 100 may be configured in a vertical stack in which the rounds of ammunition 100 are horizontally oriented, and disposed vertically one over another in a vertical stack in a side-by-side orientation, when loaded in the magazine 142. FIG. 8 is a top view of the loaded magazine 142 of FIG. 7. In some embodiments, the width of the magazine 142 may be such that a single, vertically oriented stack of shotshell type ammunition 100 fits within the magazine 142, as shown in FIG. 8.

Figure 9:
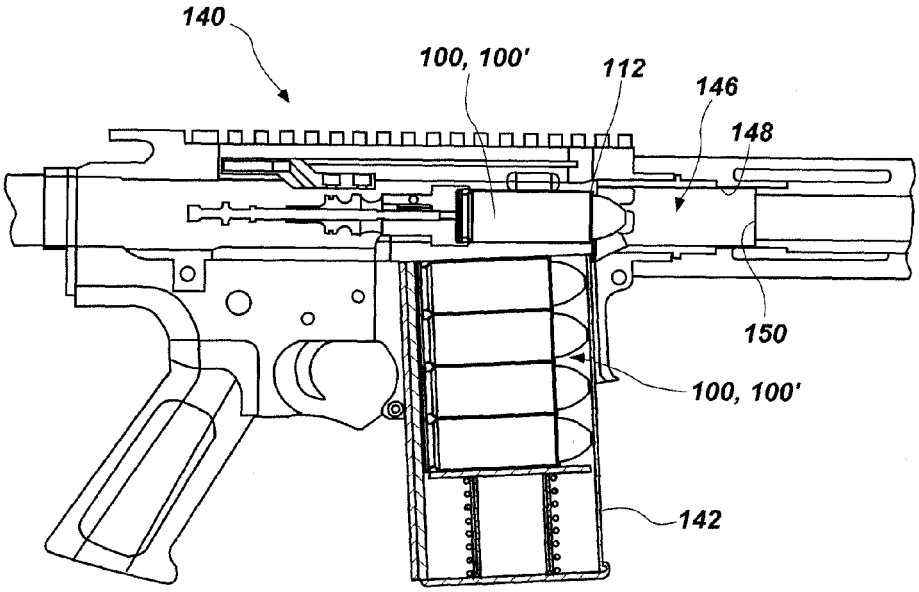
FIG. 9 is a partial cross-sectional side view of the shotgun type firearm of FIG. 6 illustrating a loaded magazine like that of FIGS. 7 and 8 attached to the firearm, and a shotshell type ammunition being moved from the magazine and into a firing chamber of the firearm.

FIG. 9 is an enlarged cross-sectional side view of a portion of the shotgun type firearm 140 of FIG. 6, with a loaded magazine 142 as shown in FIGS. 7 and 8 coupled to the firearm 140. FIG. 9 illustrates one ammunition 100 being fed from the magazine 142 and into a firing chamber 146 of the firearm 140. The firing chamber 146 of the shotgun type firearm 140 may be sized and configured to fire a shotshell type ammunition 100 as previously described herein.

Figure 10:
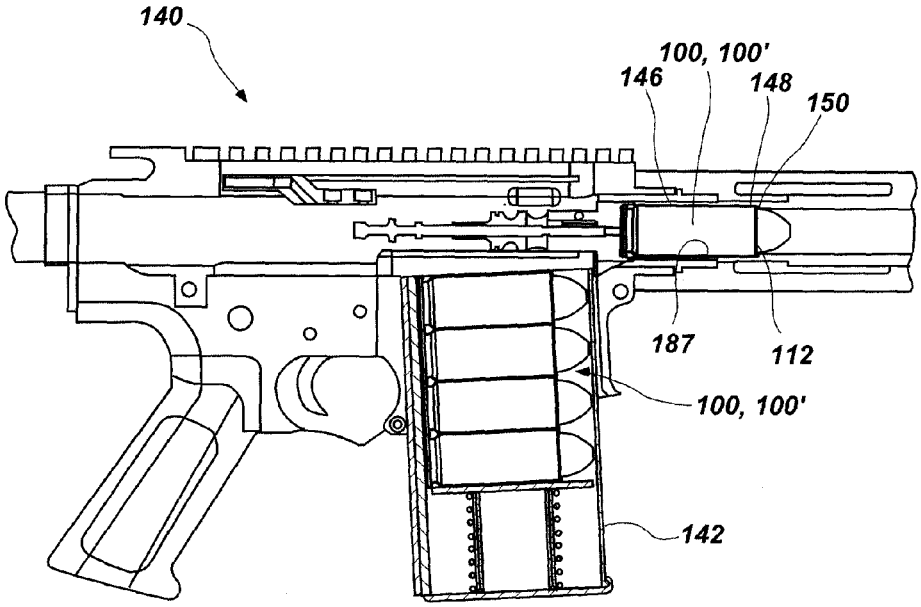
FIG. 10 is a partial cross-sectional side view like that of FIG. 9 illustrating a shotshell type ammunition fully loaded in the firing chamber of the firearm.

FIG. 10 shows a shotshell type ammunition 100 fully seated within the firing chamber 146. The firing chamber 146 of the shotgun type firearm 140 may have a generally cylindrical inner surface 187 extending through a headspace 148 within the firing chamber 146. The firing chamber 146 further includes a seat surface 150 that is located, sized, and configured to abut against the seat surface 112 of the ammunition 100 when the ammunition 100 is fully seated and properly head spaced within the firing chamber 146. Thus, the seat surface 150 may prevent longitudinal forward movement of the hull 102 (FIG. 1) within the firearm 140 when the shotshell type ammunition 100 is loaded into and fired within the firearm. As used herein, the term "headspace" means a distance from the seat surface 150, which stops forward movement of the ammunition 100 within the firing chamber 146, to the surface at the rimless proximal end 104 of the hull 102 (FIG. 2), which is the surface against which the bolt of the firearm rests at the time of firing the ammunition 100.

The generally cylindrical inner surface 187 extending through the headspace 148 within the firing chamber 146 may have any appropriate length that is at least as long as the length L of the outer side surface 106 of the hull 102 (FIG. 1) of the ammunition 100. As non-limiting examples, the generally cylindrical inner surface 187 extending through the headspace 148 may have a length of at least about 0.318 centimeters (about ⅛ of an inch), at least about 0.635 centimeters (about ¼ of an inch), at least about 1.270 centimeters (about ½ of an inch), and at least about 2.540 centimeters (about 1 inch).

Figure 11:
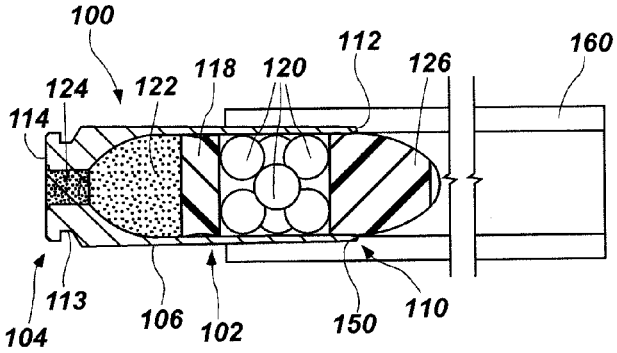
FIG. 11 is a partial cross-sectional side view illustrating a shotshell type ammunition fully loaded in the firing chamber of the firearm.
Figure 12:
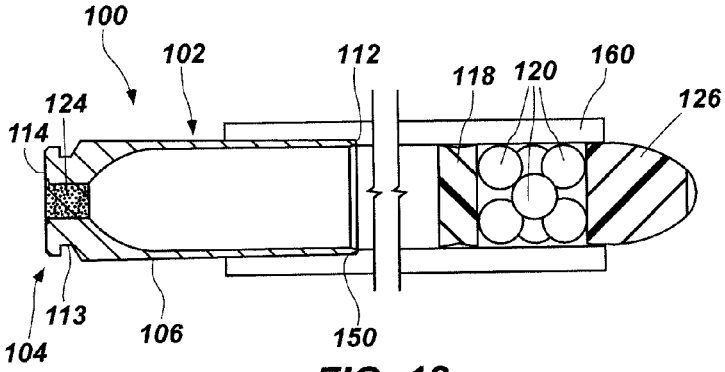
FIG. 12 is a partial cross-sectional side view like that of FIG. 11 illustrating projectiles and other components of the shotshell type ammunition moving through a barrel of the firearm after firing the shotshell type ammunition.
Figure 13:
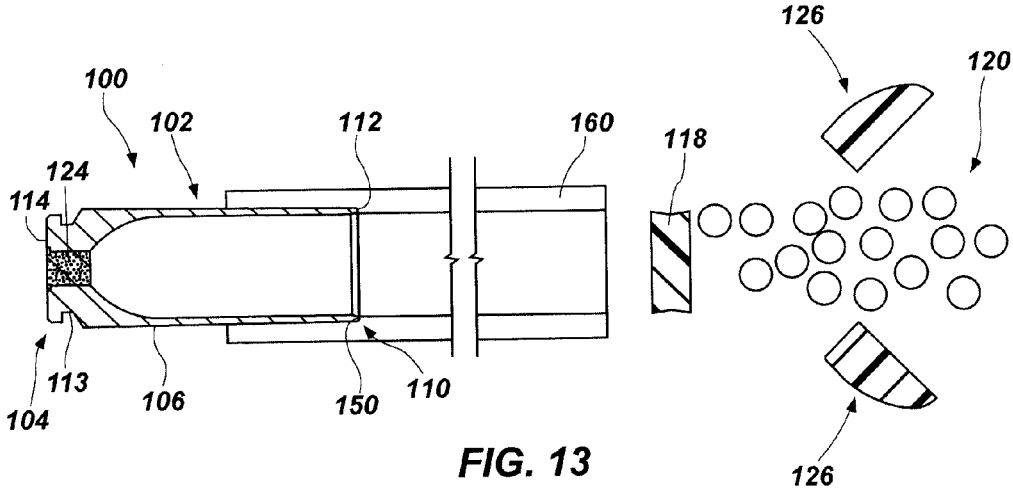
FIG. 13 is a partial cross-sectional side view like those of FIGS. 11 and 12 and illustrates the sabot opening and releasing the projectiles carried therein upon exiting the barrel of the firearm.

FIGS. 11 through 13 are simplified figures illustrating the firing of a shotshell type ammunition 100 as described herein within the firing chamber 146 and barrel 160 of the shotgun type firearm 140 of FIGS. 6 through 10. FIG. 11 illustrates the shotshell type ammunition 100 fully seated within the firing chamber 146 prior to firing the ammunition 100. As previously discussed, the shotshell type ammunition 100 may comprise a hull 102, a wad member 118, at least one projectile 120, and a nose member 126 disposed within the hull 102.

As shown in FIG. 12, upon firing the ammunition 100, the wad member 118, at least one projectile 120, and the nose member 126 are propelled out from the hull 102 and through the barrel 160 by the expanding gas generated by ignition of the gunpowder 122.

Referring to FIG. 13, as the nose member 126 exits the barrel 160, the nose member 126 may fracture and separate into two, three, or more portions, which may spread apart from one another in such a manner as to allow the one or more projectiles 120 behind the nose member 126 to pass the separated portions of the nose member 126 and continue their trajectory. The nose member 126 may fracture due, at least partially to the forces impinging on the nose member 126 by the one or more projectiles 120 behind the nose member 126 and the frictional forces imparted on the moving nose piece 126 by the air. As the nose member 126 travels through the air, the air impinging upon the nose member 126 within the recess or aperture 130 may generate forces that assist in the fracture of the nose member 126. The fracturing of the nose member 126 allows the one or more projectiles 120 to continue on their trajectory toward an intended target, while the fractured pieces of the nose member 126 rapidly decelerate and fall to the ground in relatively closer proximity to the barrel 160.

The shotshell type ammunition 100' of FIGS. 4 and 5, when fired from a firearm, will behave in a substantially similar manner to that described above in relation to the shotshell type ammunition 100 with reference to FIGS. 11 through 13.

The embodiments of shotshell type ammunition described herein with reference to FIGS. 1 through 3 are configured to facilitate use of shotshell type ammunition in semi-automatic or automatic shotgun type firearms that include a removable magazine, such as the firearm 140 described with reference to FIGS. 6 through 10. In particular, by utilizing a hull having a rimless first firing end, and a generally side surface defining a maximum diameter of the hull, which extends a distance from the rimless first firing end to a seat surface, the ammunition may be consistently stacked within a magazine in a uniform and predictable manner, which may allow consistent feeding of ammunition from the magazine and into the firing chamber of the firearm without jamming.

For example, ammunition rounds in a stack of previously known standard shotshell type ammunition, which have rimmed first firing ends, may not be oriented substantially parallel to one another when they are stacked one upon another due to the shape and configuration of the ammunition. As a result, when such ammunition is stacked one upon another in a magazine, the ammunition may not be capable of feeding from the magazine into a firing chamber of a firearm in a reliable and consistent manner without jamming.

In contrast, a stack of shotshell type ammunition 100 as described herein may be oriented substantially parallel to one another when stacked one upon another, such as within a magazine 142 as described herein. The outer side surfaces 106 of the ammunition 100 abut against one another in such a manner as to cause the ammunition 100 to align at least substantially parallel to one another in the stack. The lack of a rimmed end on the ammunition 100 further enables the ammunition 100 to be stacked in an at least substantially parallel configuration. As a result, the ammunition 100 may be capable of feeding from the magazine 142 and into a firing chamber of a firearm 140 in a relatively more reliable and consistent manner without jamming, as compared to previously known standard shotshell ammunition.

Another advantage of the various embodiments of shotshell type ammunition described herein is that the ammunition (and corresponding shotgun type firearms) may be configured differently for use with lethal and less-lethal ammunition, so as to prevent lethal ammunition from being fired from firearms intended for use only with less-lethal ammunition. For example, referring again to FIGS. 1 and 2, the distance L from the outer proximal end surface 114 of the hull 102 to the rimless proximal end 104 may be configured to correspond to a specific configuration of the shotshell type ammunition 100. For example, a first type of lethal ammunition 100 (i.e., carrying one or more lethal projectiles 120) may have a different length L compared to a second type of less-lethal ammunition 100 (i.e., carrying one or more less-lethal or non-lethal projectiles 120). Further, a barrel of a shotgun type firearm may be configured to be compatible only with shotshell type ammunition having a specific length L. For example, in one embodiment, a lethal shotgun type firearm may be configured to be compatible with only lethal shotshell type ammunition having a specific distance L, while a non-lethal or less-lethal shotgun type firearm may be configured to be compatible only with a non-lethal or less-lethal shotshell type ammunition having a shorter specific distance L. In such a configuration, the lethal shotshell type ammunition would be too long to fit properly within the firing chamber of the non-lethal shotgun type firearm, and, therefore, the lethal ammunition would not fire in the non-lethal shotgun type firearm. Such a configuration may aid in limiting accidents when only one type of shotshell type ammunition is intended to be used with a specific shotgun type firearm. The other embodiments of shotshell type ammunition described herein also may be configured differently for lethal and less-lethal ammunition, and corresponding firearms may be fabricated and configured for use with one of the lethal or less-lethal types of ammunition, so as to prevent lethal ammunition from being fired from a firearm intended for use only with less-lethal (e.g., non-lethal) types of ammunition.

Additional non-limiting example embodiments of the disclosure are set forth below.

Embodiment 1: A shotshell type ammunition, comprising: a hull having a rimless proximal end comprising a primer for firing the ammunition, an opposing distal end from which a projectile may be ejected out from the hull upon firing the ammunition, a proximal end surface at the rimless proximal end, a seat surface for seating the hull against a complementary seat surface in a firing chamber of a firearm, the seat surface located a distance from the outer proximal end surface of the hull, and an outer side surface extending from the rimless proximal end of the hull to the seat surface of the hull; a wad member disposed within the hull; and at least one projectile disposed at least partially within the hull; wherein at least a portion of the wad member is disposed longitudinally between the seat surface of the hull and the outer proximal end surface of the hull.

Embodiment 2: The shotshell type ammunition of Embodiment 1, wherein at least a portion of the at least one projectile is disposed longitudinally between the seat surface of the hull and the outer proximal end surface of the hull.

Embodiment 3: The shotshell type ammunition of Embodiment 1 or Embodiment 2, wherein the outer side surface has a first diameter, and wherein the outer proximal end surface of the hull has a second diameter at least substantially equal to or smaller than the first diameter.

Embodiment 4: The shotshell type ammunition of any one of Embodiments 1 through 3, further comprising a nose member disposed at least partially within the hull at the distal end of the hull and projecting longitudinally beyond the seat surface prior to firing of the shotshell type ammunition.

Embodiment 5: The shotshell type ammunition of Embodiment 4, wherein the nose member has a rounded end surface, the rounded end surface of the nose member projecting beyond the seat surface prior to firing of the shotshell type ammunition.

Embodiment 6: The shotshell type ammunition of Embodiment 4 or Embodiment 5, wherein the nose member is retained within the hull using an interference fit between the nose member and the hull.

Embodiment 7: The shotshell type ammunition of any one of Embodiments 1 through 6, wherein the hull comprises a cylindrical portion extending from the rimless proximal end of the hull to an open distal end of the cylindrical portion defining the distal end of the hull from which the projectile may be ejected out from the hull upon firing the ammunition, wherein a distal end surface of the cylindrical portion defines the seat surface of the hull, and wherein an outer side surface of the cylindrical portion defines the outer side surface of the hull extending from the rimless proximal end of the hull to the seat surface of the hull.

Embodiment 8: The shotshell type ammunition of Embodiment 7, wherein the cylindrical portion and the rimless proximal end of the hull are regions of a single unitary body.

Embodiment 9: The shotshell type ammunition of Embodiment 8, wherein the single unitary body comprises a plastic material.

Embodiment 10: The shotshell type ammunition of any one of Embodiments 1 through 9, further comprising a groove extending into the hull on a lateral side of the hull proximate the rimless proximal end of the hull, the groove located and configured for use in ejection of the shotshell type ammunition from a firearm.

Embodiment 11: The shotshell type ammunition of any one of Embodiments 1 through 10, wherein the distance the seat surface is located from the outer proximal end surface of the hull is at least about 0.318 centimeters (about ⅛ of an inch).

Embodiment 12: The shotshell type ammunition of Embodiment 11, wherein the distance the seat surface is located from the outer proximal end surface of the hull is at least about 0.635 centimeters (about ¼ of an inch).

Embodiment 13: The shotshell type ammunition of Embodiment 12, wherein the distance the seat surface is located from the outer proximal end surface of the hull is at least about 1.270 centimeters (about ½ of an inch).

Embodiment 14: The shotshell type ammunition of Embodiment 13, wherein the distance the seat surface is located from the outer proximal end surface of the hull is at least about 2.540 centimeters (about 1 inch).

Embodiment 15: The shotshell type ammunition of any one of Embodiments 1 through 14, wherein the at least one projectile disposed within the wad member comprises a plurality of rounded pellets.

Embodiment 16: A shotshell type ammunition, comprising: a hull having a rimless proximal end comprising a primer for firing the ammunition, an opposing distal end from which a projectile may be ejected out from the hull upon firing the ammunition, a proximal end surface at the rimless proximal end, a seat surface for seating the hull against a complementary seat surface in a firing chamber of a firearm, the seat surface located at least about 0.635 centimeters (about ¼ of an inch) from the outer proximal end surface of the hull, and an outer side surface extending from the rimless proximal end of the hull to the seat surface of the hull; a wad member disposed within the hull; and at least one projectile disposed at least partially within the hull; wherein the wad member and at least a portion of the at least one projectile are disposed longitudinally between the seat surface of the hull and the outer proximal end surface of the hull.

Embodiment 17: A method of manufacturing a shotshell type ammunition, comprising: forming a hull having a rimless proximal end, an opposing distal end from which a projectile may be ejected out from the hull upon firing the ammunition, a seat surface for seating the hull against a complementary seat surface in a firing chamber of a firearm, the seat surface located a distance from an outer proximal end surface of the hull at the rimless proximal end, and an outer side surface extending from the rimless proximal end of the hull to the seat surface of the hull; providing a primer at the rimless proximal end of the hull for firing the ammunition; providing gun powder within the hull; providing a wad member within the hull at a location at which at least a portion of the wad member is disposed longitudinally between the seat surface of the hull and the outer proximal end surface of the hull; and providing at least one projectile within the hull.

Embodiment 18: The method of Embodiment 17, wherein at least a portion of the at least one projectile is disposed longitudinally between the seat surface of the hull and outer proximal end surface of the hull.

Embodiment 19: The method of Embodiment 17 or Embodiment 18, further comprising a nose member disposed at least partially within the hull at the distal end of the hull and projecting longitudinally beyond the seat surface prior to firing of the shotshell type ammunition.

Embodiment 20: The method of any one of Embodiments 17 through 19, wherein the distance the seat surface is located from the outer proximal end surface of the hull is at least about 0.318 centimeters (about ⅛ of an inch).

Embodiment 21: The method of Embodiment 20, wherein the distance the seat surface is located from the outer proximal end surface of the hull is at least about 0.635 centimeters (about ¼ of an inch).

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternative useful combinations of the elements described, will become apparent to those skilled in the art from the description. Such modifications and embodiments are also intended to fall within the scope of the appended claims.

What is claimed is:

1. A shotshell ammunition sized and configured for firing from a semi-automatic or automatic shotgun firearm having a magazine for feeding the shotshell ammunition into a firing chamber of the shogun firearm, comprising:

a plastic hull having a rimless proximal end comprising a primer for firing the ammunition, an opposing distal end from which a projectile may be ejected out from the hull upon firing the ammunition, an outer proximal end surface of the hull located at the rimless proximal end, a seat surface for seating the hull against a complementary seat surface in a firing chamber of a firearm, the seat surface located a distance of at least about 2.540 centimeters (about 1 inch) from the outer proximal end surface of the hull, and a cylindrical portion extending from the rimless proximal end of the hull to an open distal end of the cylindrical portion defining the distal end of the hull from which the projectile may be ejected out from the hull upon firing the ammunition, a distal end surface of the cylindrical portion defining the seat surface of the hull, the cylindrical portion having a cylindrical outer side surface extending from the rimless proximal end of the hull to the seat surface of the hull, the cylindrical outer side surface having a diameter in a range extending from about 1.775 centimeters (about 0.699 inches) to about 2,370 centimeters (about 0.933 inches), the plastic hull sized and configured such that the cylindrical outer side surface of the cylindrical portion of the plastic hull causes the shotshell ammunition to align at least substantially parallel to other identical shotshell ammunitions when the shotshell ammunition and the other identical shotshell ammunitions are vertically stacked in the magazine of the semi-automatic or automatic shotgun firearm;

a nose member disposed at least partially within the hull at the distal end of the hull and having a rounded end surface projecting longitudinally beyond the seat surface prior to firing of the shotshell ammunition;

a wad member disposed within the hull; and at least one projectile disposed at least partially within the hull;

wherein at least a portion of the wad member is disposed longitudinally between the seat surface of the hull and the outer proximal end surface of the hull.

2. The shotshell ammunition of claim 1, wherein at least a portion of the at least one projectile is disposed longitudinally between the seat surface of the hull and the outer proximal end surface of the hull.

3. The shotshell ammunition of claim 1, wherein the outer side surface has a first diameter, and wherein the outer proximal end surface of the hull has a second diameter at least substantially equal to or smaller than the first diameter.

4. The shotshell ammunition of claim 1, wherein the nose member is retained within the hull using an interference fit between the nose member and the hull.

5. The shotshell ammunition of claim 1, wherein the cylindrical portion and the rimless proximal end of the hull are regions of a single unitary body.

6. The shotshell ammunition of claim 1, further comprising a groove extending into the hull on a lateral side of the hull proximate the rimless proximal end of the hull, the groove located and configured for use in ejection of the shotshell ammunition from a firearm.

7. The shotshell ammunition of claim 1, wherein the at least one projectile disposed within the wad member comprises a plurality of rounded pellets.

8. A method of manufacturing a shotshell ammunition sized and configured for firing from a semi-automatic or automatic shotgun firearm having a magazine for feeding the shotshell ammunition into a firing chamber of the shotgun firearm, comprising:

forming a plastic hull having a rimless proximal end, an opposing distal end from which a projectile may be ejected out from the hull upon firing the ammunition, a seat surface for seating the hull against a complementary seat surface in a firing chamber of a firearm, the seat surface located a distance from an outer proximal end surface of the hull at the rimless proximal end, the seat surface located a distance of at least about 2.540 centimeters (about 1 inch) from the outer proximal end surface of the hull, a cylindrical portion extending from the rimless proximal end of the hull to an open distal end of the cylindrical portion defining the distal end of the hull from which the projectile may be ejected out from the hull upon firing the ammunition, a distal end surface of the cylindrical portion defining the seat surface of the hull, the cylindrical portion having a cylindrical outer side surface extending from the rimless proximal end of the hull to the seat surface of the hull, the cylindrical outer side surface having a diameter in a range extending from about 1.775 centimeters (about 0.699 inches) to about 2.370 centimeters (about 0.933 inches), the plastic hull sized and configured such that the cylindrical outer side surface of the cylindrical portion of the plastic hull causes the shotshell ammunition to align at least substantially parallel to other identical shotshell ammunitions when the shotshell ammunition and the other identical shotshell ammunitions are vertically stacked in the magazine of the semi-automatic or automatic shotgun firearm;

providing a primer at the rimless proximal end of the hull for firing the ammunition;

providing gun powder within the hull;

providing a wad member within the hull at a location at which at least a portion of the wad member is disposed longitudinally between the seat surface of the hull and the outer proximal end surface of the hull;

providing at least one projectile within the hull; and providing a nose member disposed at least partially within the hull at the distal end of the hull and projecting longitudinally beyond the seat surface prior to firing of the shotshell ammunition.

9. The method of claim 8, wherein at least a portion of the at least one projectile is disposed longitudinally between the seat surface of the hull and outer proximal end surface of the hull.

* * * * *